US010830525B2

(12) United States Patent
Lottinville et al.

(10) Patent No.: US 10,830,525 B2
(45) Date of Patent: Nov. 10, 2020

(54) HINGE ASSEMBLY

(71) Applicant: WHIRLPOOL CORPORATION, Benton Harbor, MI (US)

(72) Inventors: Daniel Lottinville, Stevensville, MI (US); Lynne F. Hunter, Dorr, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 192 days.

(21) Appl. No.: 16/077,807

(22) PCT Filed: May 25, 2017

(86) PCT No.: PCT/US2017/034509
§ 371 (c)(1),
(2) Date: Aug. 14, 2018

(87) PCT Pub. No.: WO2018/075094
PCT Pub. Date: Apr. 26, 2018

(65) Prior Publication Data

US 2020/0002987 A1 Jan. 2, 2020

Related U.S. Application Data

(60) Provisional application No. 62/408,984, filed on Oct. 17, 2016.

(51) Int. Cl.
*F25D 23/02* (2006.01)
*E05D 3/16* (2006.01)
(Continued)

(52) U.S. Cl.
CPC ..... *F25D 23/028* (2013.01); *E05D 3/16* (2013.01); *E05D 11/06* (2013.01);
(Continued)

(58) Field of Classification Search
CPC ..... F25D 23/00; F25D 23/02; F25D 23/028; E05D 3/16; E05D 11/06; E05D 11/1014; E05D 15/28
(Continued)

(56) References Cited

U.S. PATENT DOCUMENTS 3,006,708 A 10/1961 Saunders et al.
3,157,306 A 11/1964 Courson
(Continued)

FOREIGN PATENT DOCUMENTS

CN 104806103 A 7/2015
DE 4418238 A1 11/1995
(Continued)

*Primary Examiner* — James O Hansen
(74) *Attorney, Agent, or Firm* — Price Heneveld LLP

(57) ABSTRACT

A refrigerator is provided herein. The refrigerator includes a cabinet defining a compartment. A door is configured to seal the compartment and is operable between open and closed positions. A hinge assembly is operably coupled to the cabinet and to the door. The hinge assembly includes a first link coupled to the cabinet. A second link is pivotable about the first link. A third link is pivotable about the second link and a fourth link. The fourth link is further coupled to the door. A fifth link is pivotable about the second link and the fourth link. A sixth link is pivotable about an intermediate portion of the fifth link and the first link. The sixth link is disposed through a void defined by the fifth link.

20 Claims, 11 Drawing Sheets

(51) Int. Cl.
*E05D 15/28* (2006.01)
*E05D 11/10* (2006.01)
*E05D 11/06* (2006.01)

(52) U.S. Cl.
CPC ..... *E05D 11/1014* (2013.01); *E05D 15/28* (2013.01); *E05D 2003/166* (2013.01); *E05Y 2201/224* (2013.01); *E05Y 2600/53* (2013.01); *E05Y 2600/63* (2013.01); *E05Y 2900/31* (2013.01); *F25D 2323/021* (2013.01)

(58) Field of Classification Search
USPC ..... 312/401, 405, 326, 329; 16/366, 368, 16/370, 371
See application file for complete search history.

(56) References Cited

U.S. PATENT DOCUMENTS 3,452,387 A 7/1969 Jerila et al.
3,518,716 A 7/1970 Larson
3,608,129 A 9/1971 Heyer et al.
3,788,094 A 1/1974 Benasutti et al.
4,070,728 A 1/1978 Herman
4,115,901 A 9/1978 Schmidt
4,170,391 A 10/1979 Bottger
4,189,805 A 2/1980 Backus
4,383,414 A 5/1983 Beitner
4,550,576 A 11/1985 Tate, Jr. et al.
4,646,472 A 3/1987 Sugawara
4,690,468 A 9/1987 Lau
4,696,078 A 9/1987 Stromquist
4,715,090 A * 12/1987 Morris ..... E05D 7/1044 16/261
4,774,740 A 10/1988 Gidseg et al.
4,787,121 A 11/1988 Racenis et al.
4,864,691 A 9/1989 Gidseg et al.
4,912,942 A 4/1990 Katterhenry et al.
4,914,781 A 4/1990 Sokn et al.
4,914,782 A 4/1990 Rupprechter
5,158,503 A 10/1992 Mitchell
5,253,433 A 10/1993 Frey
5,263,509 A 11/1993 Cherry et al.
5,265,954 A 11/1993 Keil
5,349,832 A 9/1994 Johnson et al.
5,419,640 A 5/1995 Doring
5,483,770 A 1/1996 Marinoni
5,522,656 A * 6/1996 Jenkins ..... E05F 1/1246 126/194
6,036,294 A 3/2000 Banicevic et al.
6,141,830 A 11/2000 Shimooka
6,308,376 B1 10/2001 Koshikawa
6,568,035 B2 5/2003 Zetti
7,322,209 B2 1/2008 Hwang et al.
7,334,293 B2 2/2008 Erickson et al.
7,406,749 B2 8/2008 Herper
7,517,031 B2 4/2009 Laible
7,520,578 B2 4/2009 Tarantik
7,987,558 B2 8/2011 Beckmann et al.
8,162,415 B2 4/2012 Hagele et al.
8,162,421 B2 4/2012 Lim et al.
8,197,019 B2 6/2012 Kim
8,254,103 B2 8/2012 Park et al.
8,307,502 B2 11/2012 Bonomie et al.
8,491,070 B2 7/2013 Davis et al.
8,499,577 B2 8/2013 Watson et al.
8,506,026 B2 8/2013 Kim et al.
8,511,768 B2 8/2013 Brachert
8,572,808 B2 11/2013 Bonomie et al.
8,650,712 B2 2/2014 Wach et al.
8,720,008 B2 5/2014 Dodge et al.
8,752,921 B2 6/2014 Gorz et al.
8,764,133 B2 7/2014 Park et al.
8,925,344 B2 1/2015 Mitchell et al.
9,052,135 B2 6/2015 Trulaske, Sr.
9,115,928 B2 8/2015 Akalan et al.
9,212,846 B2 12/2015 Lee et al.
9,222,293 B2 12/2015 Jenkinson
9,267,721 B2 2/2016 Hunter
9,322,592 B2 4/2016 Kim et al.
9,328,954 B2 5/2016 Kang et al.
9,568,239 B2 * 2/2017 Kim ..... F25D 23/025
9,593,518 B2 3/2017 Downs et al.
9,790,722 B2 10/2017 Sun et al.
9,823,011 B2 11/2017 Kempte
2005/0262663 A1 12/2005 Lee
2006/0097612 A1 5/2006 Park
2008/0120807 A1 5/2008 Heger
2009/0077995 A1 3/2009 Ihle et al.
2012/0080991 A1 4/2012 Wilson
2015/0059126 A1 3/2015 Dubina et al.
2016/0195325 A1 * 7/2016 Kim ..... E05D 3/16 312/405
2017/0003069 A1 1/2017 Moertl et al.
2017/0130502 A1 5/2017 Collene
2017/0191210 A1 7/2017 Jung et al.
2018/0031302 A1 2/2018 Park et al.

FOREIGN PATENT DOCUMENTS

DE 102005004957 A1 8/2006
DE 202007004621 U1 8/2008
DE 102007058690 A1 6/2009
DE 102011115930 A 1/2013
DE 102005063588 B3 7/2013
EP 0565900 A1 10/1993
EP 0952290 A2 10/1999
FR 2668180 A1 4/1992
JP 2015204928 A 11/2015
KR 10200040105030 A 12/2004
KR 200457300 Y1 12/2011
RU 2448208 C1 4/2012
WO 2006069882 A1 7/2006
WO 2007072206 A2 6/2007
WO 2012032815 A1 3/2012

* cited by examiner

HINGE ASSEMBLY

CROSS-REFERENCE TO RELATED APPLICATION

This application claims priority to International Application No. PCT/US2017/034509, filed May 25, 2017, entitled "HINGE ASSEMBLY," which further claims priority to U.S. Provisional Application No. 62/408,984, filed Oct. 17, 2016, entitled "HINGE ASSEMBLY".

BACKGROUND

Hinges having a single pivot point are commonly used for a coupling a door to an appliance. In some circumstances, however, it is desired to utilize multi-pivot-point hinges that allow full accessibility to a compartment of the appliance.

BRIEF SUMMARY OF THE DISCLOSURE

According to one aspect of the disclosure, a refrigerator is disclosed. The refrigerator includes a cabinet defining a compartment. A door is configured to seal the compartment and is operable between open and closed positions. A hinge assembly is operably coupled to the cabinet and to the door. The hinge assembly includes a first link coupled to the cabinet. A second link is pivotable about the first link. A third link is pivotable about the second link and a fourth link. The fourth link is further coupled to the door. A fifth link is pivotable about the second link and the fourth link. A sixth link is pivotable about an intermediate portion of the fifth link and the first link. The sixth link is disposed through a void defined by the fifth link.

According to another aspect of the present disclosure, a refrigerator is disclosed. The refrigerator includes a cabinet defining a compartment. The cabinet includes a pair of side walls that extend forwardly of the compartment. A door is coupled to the cabinet. A hinge assembly is coupled to the cabinet and to the door. The hinge assembly includes a six-link mechanism that translates and rotates the door forwardly and outwardly of at least one side wall when the door is moved from a closed position to the open position.

According to yet another aspect of the present disclosure, a refrigerator is disclosed. The refrigerator includes a cabinet defining a compartment and including a pair of side walls that extends forwardly of the compartment. A door is coupled to the cabinet. A hinge assembly is coupled to the cabinet and to the door. The hinge assembly includes a six-link mechanism that keeps the door within a predefined clearance distance of at least one side wall when the door is moved from the closed position to the open position.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, certain examples are shown in the drawings. It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

DETAILED DESCRIPTION

As required, detailed examples of the present disclosure are disclosed herein. However, it is to be understood that the disclosed examples are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

It is to be understood that the present disclosure is not limited to the particular examples described below, as variations of the particular examples may be made and still fall within the scope of the appended claims. It is also to be understood that the terminology employed is for the purpose of describing particular examples, and is not intended to be limiting. Instead, the scope of the present disclosure will be established by the appended claims.

Figure 1:
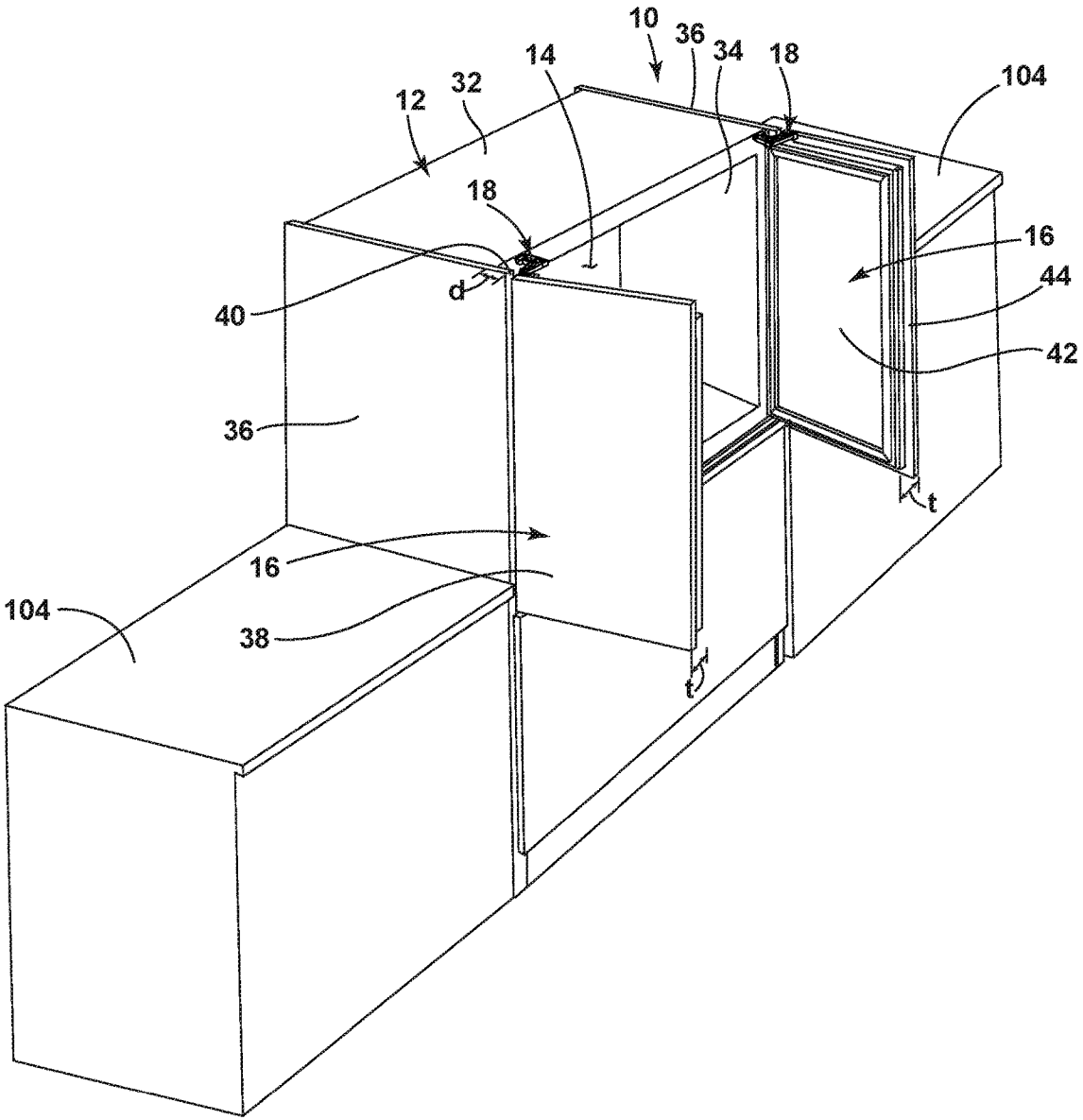
FIG. 1 is a top perspective view of a refrigerator having a hinge assembly coupling a door to a cabinet, according to some examples.

For purposes of description herein, the terms "upper," "lower," "right," "left," "rear," "front," "vertical," "horizontal," and derivatives thereof shall relate to the disclosure as oriented in FIG. 1, unless stated otherwise. However, it is to be understood that the disclosure may assume various alternative orientations, except where expressly specified to the contrary. It is also to be understood that the specific devices and processes illustrated in the attached drawings, and described in the following specification, are simply exemplary examples of the inventive concepts defined in the appended claims. Hence, specific dimensions and other physical characteristics relating to the examples disclosed herein are not to be considered as limiting, unless the claims expressly state otherwise.

Referring to FIGS. 1-11, a refrigerator 10 includes a cabinet defining a compartment 14. A door 16 is configured to seal the compartment 14 and is operable between open and closed positions. A hinge assembly 18 is operably coupled to the cabinet 12 and to the door 16. The hinge assembly 18 includes a first link 20 coupled to the cabinet 12. A second link 22 is pivotable about the first link 20. A third link 24 is pivotable about the second link 22 and a fourth link 26. The fourth link 26 is further coupled to the door 16. A fifth link 28 is pivotable about the second link 22 and the fourth link 26. A sixth link 30 is pivotable about an intermediate portion of the fifth link 28 and the first link 20. The sixth link 30 is disposed through a void 144 defined by the fifth link 28.

Referring now to FIG. 1, the cabinet 12 is formed from a wrapper 32 and a liner 34 and defines one or more compartments 14. The one or more compartments 14 may be configured as a fresh food compartment, a freezer compartment, and/or any other desired compartment known in the art. The refrigerator 10 also includes a refrigeration system (not shown). The refrigeration system includes various components for generating chilled air within the one or more compartments 14, as will be understood by those skilled in the art. It will be appreciated that the one or more compartments 14 may have any suitable arrangement without departing from the scope of the present disclosure.

The door 16 may include an inner door panel 42 and an outer door panel 44. The outer door panel 44 may be a decorative door panel, such as a metal or wood door panel, which is attached by any suitable means to the inner door panel 42. The inner door panel 42 may be constructed of any suitable material, such as an inner plastic liner, and may cooperate with the cabinet 12 when the door 16 is closed in order to seal the one or more compartments 14.

The hinge assembly 18 is operably coupled to the cabinet 12 and to the door 16. The hinge assembly 18 is configured to move the door 16 between the open and the closed positions to provide access to the one or more compartments 14. As will be discussed in greater detail below, the hinge assembly 18 may be configured to rotate the door 16 relative to the cabinet 12 and/or translate the door 16 towards and away from the cabinet 12 when the door 16 is moved between the open and closed positions.

With further reference to FIG. 1, the wrapper 32 includes a pair of side walls 36 that may extend beyond the one or more compartments 14. The pair of side walls 36 may extend a distance d forwardly of the one or more compartments 14. Likewise, the door 16 has a thickness t causing a front surface 38 of the door 16 to extend forwardly of the one or more compartments 14 when the door 16 is in the closed position. In some examples, the distance d of the side wall 36 extension and the thickness t of the door 16 may be substantially equal such that a front surface 40 of the side wall 36 and the front surface 38 of the door 16 may substantially align when the door 16 is in the closed position. Accordingly, in some examples, the refrigerator 10 may be configured as a "flush-mounted refrigerator" because a front of the refrigerator 10 lies substantially aligned, or substantially flush, with a front of adjacent cabinetry 104, as is understood by those skilled in the art. For purposes of the present disclosure, "substantially aligned" and "substantially flush" mean that a surface of the door 16 and a surface of the cabinet 12 extend in a generally common direction. It will be understood that the door 16 and/or the cabinet 12 may be offset from one another in a non-aligned manner and that such assemblies may still be considered to be "substantially aligned" or "substantially flush" in accordance with the present disclosure. For example, the door 16 may be offset from any surface of the cabinet 12 by any predefined distance (e.g., 200 mm or less) and still be considered "substantially aligned" or "substantially flush."

It will be understood that the refrigerator 10 may take a variety of configurations, including French door, side-by-side, top freezer, bottom freezer, counter depth, compact, built-in, and/or other types of refrigerators 10. The door 16 may be either a refrigerator door or a freezer door. Although the hinge assembly 18 is depicted as positioned on right and left sides of the refrigerator 10, the hinge assembly 18 may be used on any other location (top, center, bottom, or sides). In various examples, portions of the hinge assembly 18 may be hidden or concealed using a cover, which may create an aesthetically pleasing hinge assembly 18.

Figure 2:
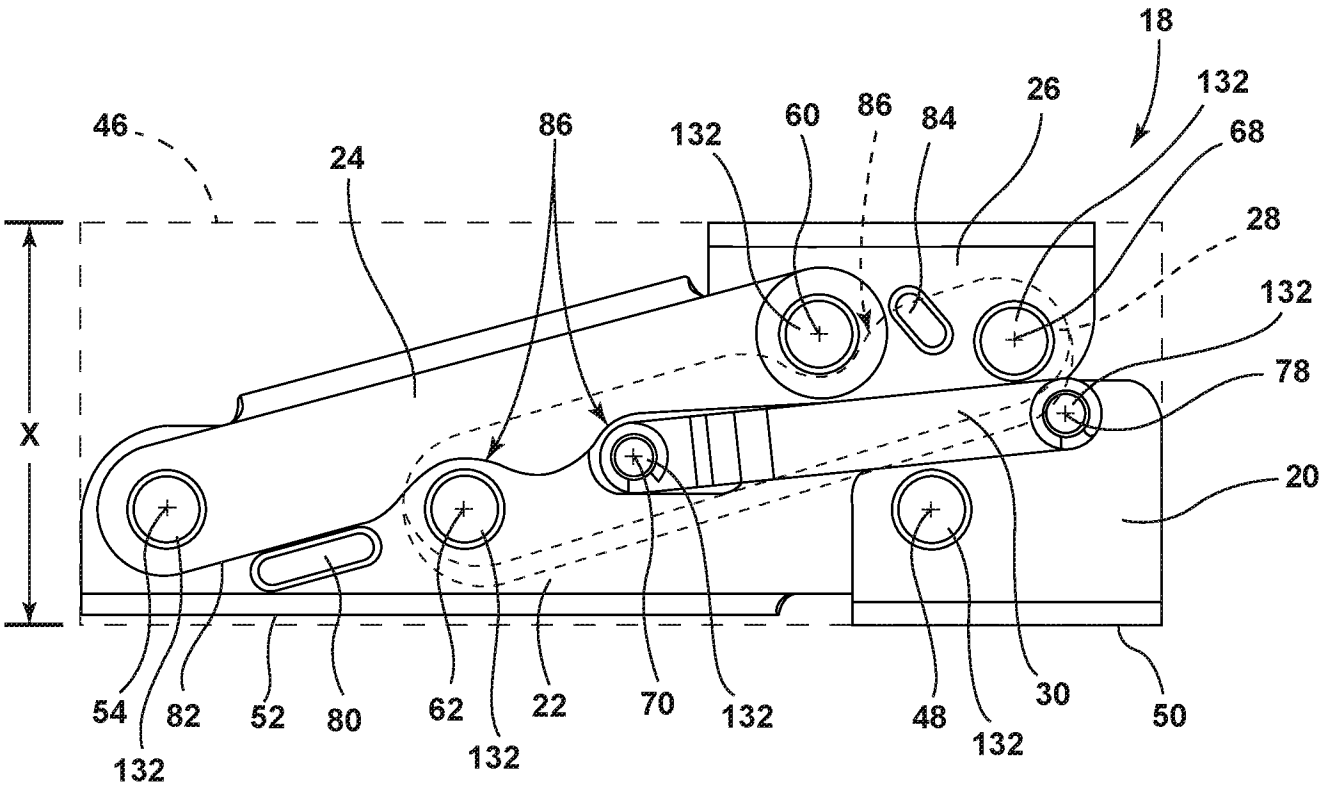
FIG. 2 is a top plan view of the hinge assembly in the contracted position, according to some examples.
Figure 3:
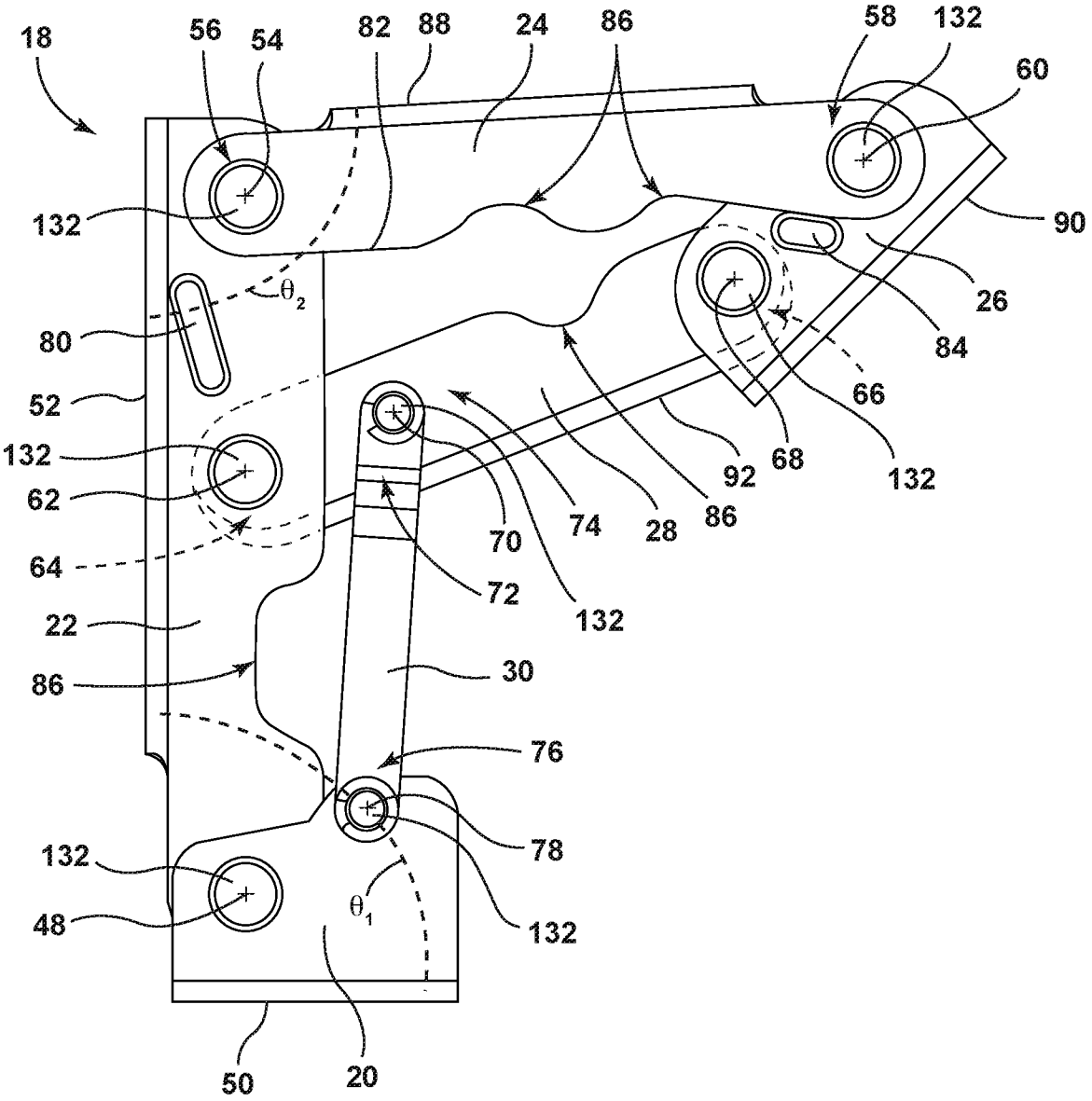
FIG. 3 is a top plan view of the hinge assembly in the expanded position, according to some examples.

Referring to FIGS. 2 and 3, the hinge assembly 18 is illustrated in a contracted position (FIG. 2) and an expanded position (FIG. 3). When the refrigerator 10 is assembled, the contracted position places the door 16 in the closed position. The expanded position places the door 16 in the open position. The hinge assembly 18 may also be placed in a plurality of intermediate positions between the contracted and expanded positions. A contracted position envelope 46 is defined by a packaging space for placement of the hinge assembly 18 in the contracted position and may be disposed in a position that is forward of the compartment 14. Accordingly, in some examples, the hinge assembly 18 may be coupled to an outer and/or front surface of the cabinet 12. The contracted position envelope 46 has a thickness x that may be less than the thickness t of the door 16. Accordingly, the hinge assembly 18 may be concealed when the door 16 is in the closed position. The thickness x of the contracted position envelope 46 may also be less than the side wall 36 extension distance d.

Referring to FIGS. 2 and 3, the hinge assembly 18 may be configured as a six-link mechanism. For example, according to some examples, the hinge assembly 18 may include a Watt's six-link mechanism for movement. The selection of a Watt's six-link mechanism allows for a wide-open position and/or a large range of motion, although other link isomers and isomer variations may be selected without departing from the scope of the present disclosure.

Figure 5:
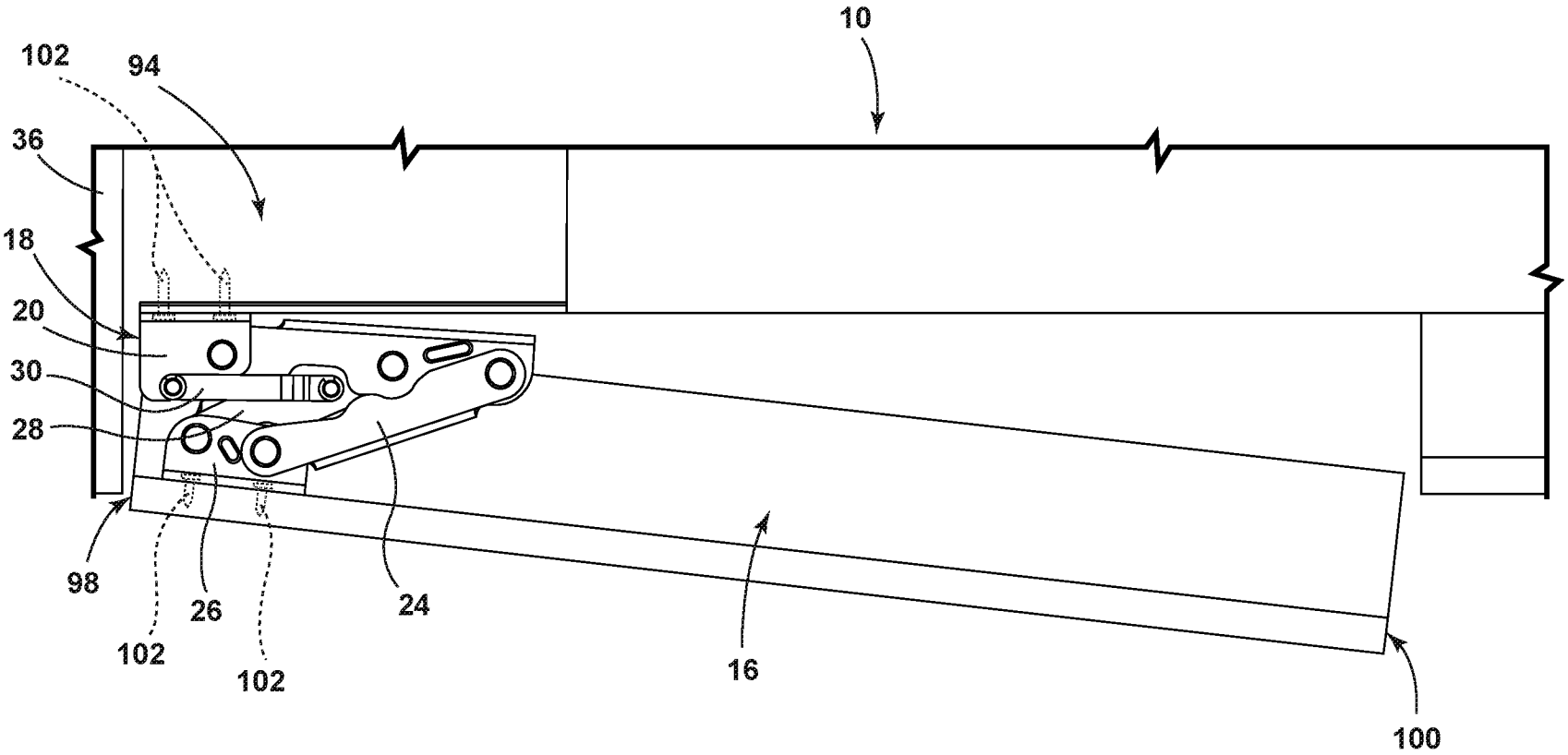
FIG. 5 is a partial top plan view of the refrigerator with the door in a first intermediate position.
Figure 6:
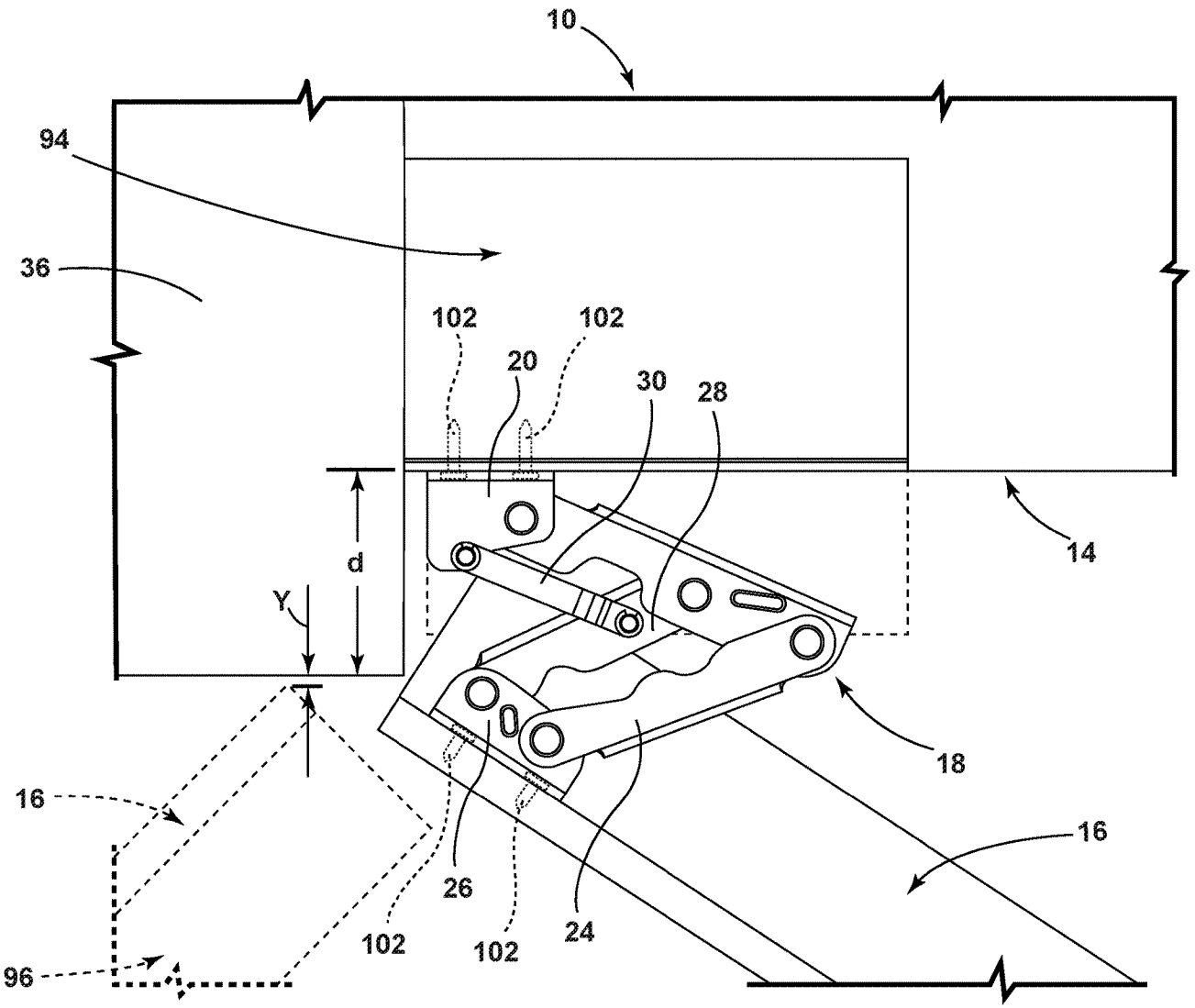
FIG. 6 is a partial top plan view of the refrigerator with the door in a second intermediate position and an open position.

The six links 20, 22, 24, 26, 28, 30 of the hinge assembly 18 define seven pivot points 48, 54, 60, 62, 68, 70, 78. The first link 20 is configured as a bracket that is coupled to the cabinet 12 through any means known in the art, such as, but not limited to, mechanical fasteners 102 (FIG. 5). The second link 22 pivots about the first link 20 at a first pivot point 48, which may include a pivotable member 132, such as a pin, a rivet, a pivot rod 106 (FIG. 7) and/or any other pivot device known in the art. The second link 22 may extend along a surface of the cabinet 12 when the hinge assembly 18 is in the contracted position. Accordingly, a rear surface, or vertical surface, 50 of the first link 20 and a rear surface, or vertical surface, 52 of the second link 22 may be coplanar and/or parallel in the contracted position.

The third link 24 pivots about the second link 22 at a second pivot point 54 at a first end portion 56 of the third link 24. At an opposing second end portion 58 of the third link 24, the third link 24 pivots about the fourth link 26 at a third pivot point 60. Likewise, the fifth link 28 also pivots about the second link 22 at a fourth pivot point 62 at a first end portion 64 of the fifth link 28. At an opposing second end portion 66, the fifth link 28 pivots about the fourth link 26 at a fifth pivot point 68.

The sixth link 30 pivots about the fifth link 28 at sixth pivot point 70 at one end portion 72 of the sixth link 30. The sixth pivot point 70 may be disposed on an intermediate portion 74 of the fifth link 28 between the fourth and fifth pivot points 62, 68. The sixth link 30 further pivots about the first link 20 on a second end portion 76 about a seventh pivot point 78 thereby completing the six-link mechanism. In some examples, the second pivot point 54 and the fourth pivot point 62 may be further in distance from one another than the third pivot point 60 to the fifth pivot point 68. According to some examples, the hinge assembly 18 may be positioned above a top surface of the cabinet 12. The first link 20 may extend along the cabinet 12 of the refrigerator 10. The second link 22 may extend orthogonally from the first link 20 in the open position.

With further reference to FIGS. 2 and 3, a first stop 80 is integrally formed, or otherwise disposed, on the second link 22 and may be configured as a raised portion, or any other stop known in the art. When the hinge assembly 18 is disposed in the contracted position, an interior surface 82 of the third link 24 may contact the first stop 80. Similarly, a second stop 84 may be disposed on the fourth link 26 that contacts the interior surface 82 of third link 24 in the open position.

With further reference to FIGS. 2 and 3, any of the links 20,22, 24, 26, 28, 30 may define a relief 86 thereon. For example, the second, third and fifth links 22, 24, 28 may define one or more reliefs 86 thereon. The reliefs 86 may be configured as an indentation, a notch, an aperture, and/or any other feature on any of the links 20, 22, 24, 26, 28, 30. The reliefs 86 may each be configured to allow the hinge assembly 18 to compactly dispose some links 20, 22, 24, 26, 28, 30 over others when the hinge assembly 18 is in the contracted position to reduce the contracted position envelope 46 (packaging space) of the hinge assembly 18.

According to some examples, each link 20, 22, 24, 26, 28, 30 is formed by a stamping operation and subsequently coupled to one another 20, 22, 24, 26, 28, 30 at the pivot points 48, 54, 60, 62, 68, 70, 78. A die may be used to cut the links 20, 22, 24, 26, 28, 30 from stock material and form any desired features, such as stops 80, 84 and/or reliefs 86. A plurality of links 20, 22, 24, 26, 28 may include vertical surfaces 50, 52, 88, 90, 92 that transversely extend from a top surface 108, 110, 112, 114, 116 (FIG. 7) of each respective link 20, 22, 24, 26, 28. The transversely, vertically extending surfaces 50, 52, 88, 90, 92 may be disposed around a perimeter of the hinge assembly 18 and also formed by the die and/or any other bending and/or forming process.

Referring still to FIGS. 2 and 3, when the hinge assembly 18 is in the contracted position, as illustrated in FIG. 2, the first and second links 20, 22 extend in a substantially common direction. As the hinge assembly 18 is moved to the expanded position, as illustrated in FIG. 3, a change in angle $\theta_1$, which may be defined by the relationship between the first and second pivot points 48, 54, may be greater than sixty (60) degrees. In some examples, the change in angle $\theta_1$ may be ninety (90) degrees or greater. Likewise, in some examples, when the hinge assembly 18 is in the expanded position, an angle $\theta_2$ between the second and third links 22, 24 may be about seventy (70) degrees or more. Further, the fifth link 28 may be transverse to the third and/or fourth links 24, 26 in the open position. Accordingly, in the open position, the second and fifth links 22, 28 may be substantially parallel. Additionally, the third link 24, the fourth link 26, and/or the adjacent cabinet may be substantially aligned when the hinge is in the open position.

Figure 4:
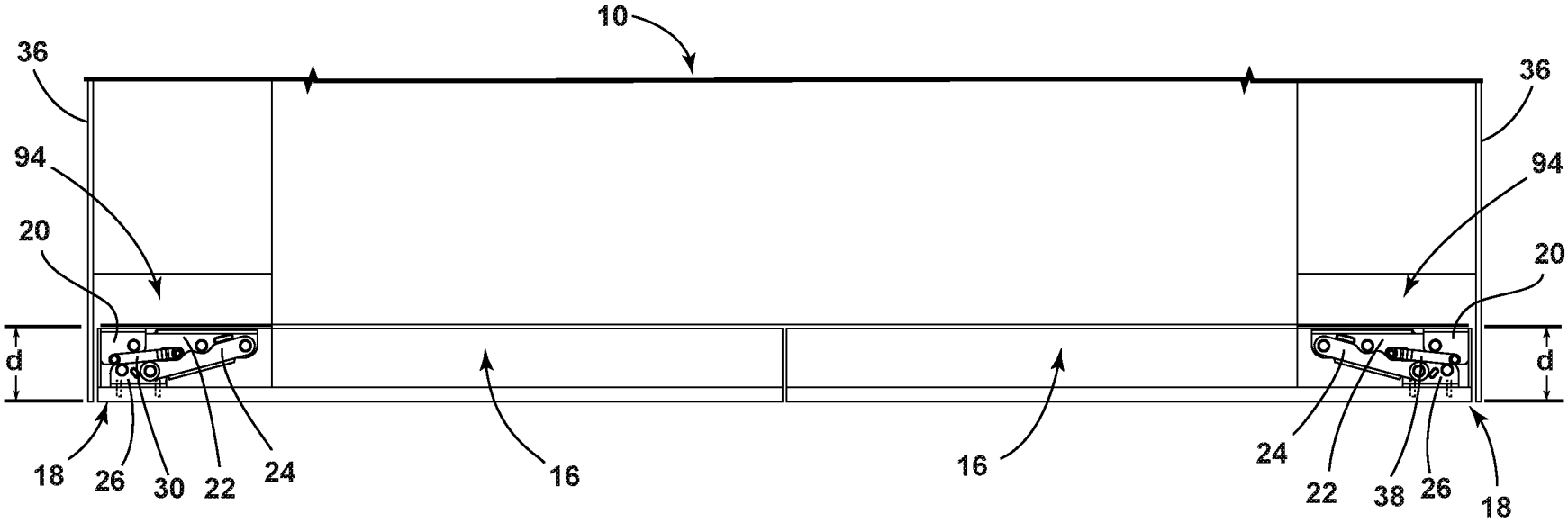
FIG. 4 is a top plan view of the refrigerator having a pair of doors each in a closed position.

Referring to FIGS. 4 and 5, a top bracket 94 is disposed on the cabinet 12 and configured to couple to the hinge assembly 18. As the door 16 is opened, the door 16 translates and rotates so that the door 16 is displaced forwardly of the side wall 36 and/or the opposing door 16. As the door 16 approaches the open position, the door 16 may be disposed in a position 96 (FIG. 6) outwardly of the compartment 14 thereby allowing access to a substantial amount of the compartment 14.

Figure 7:
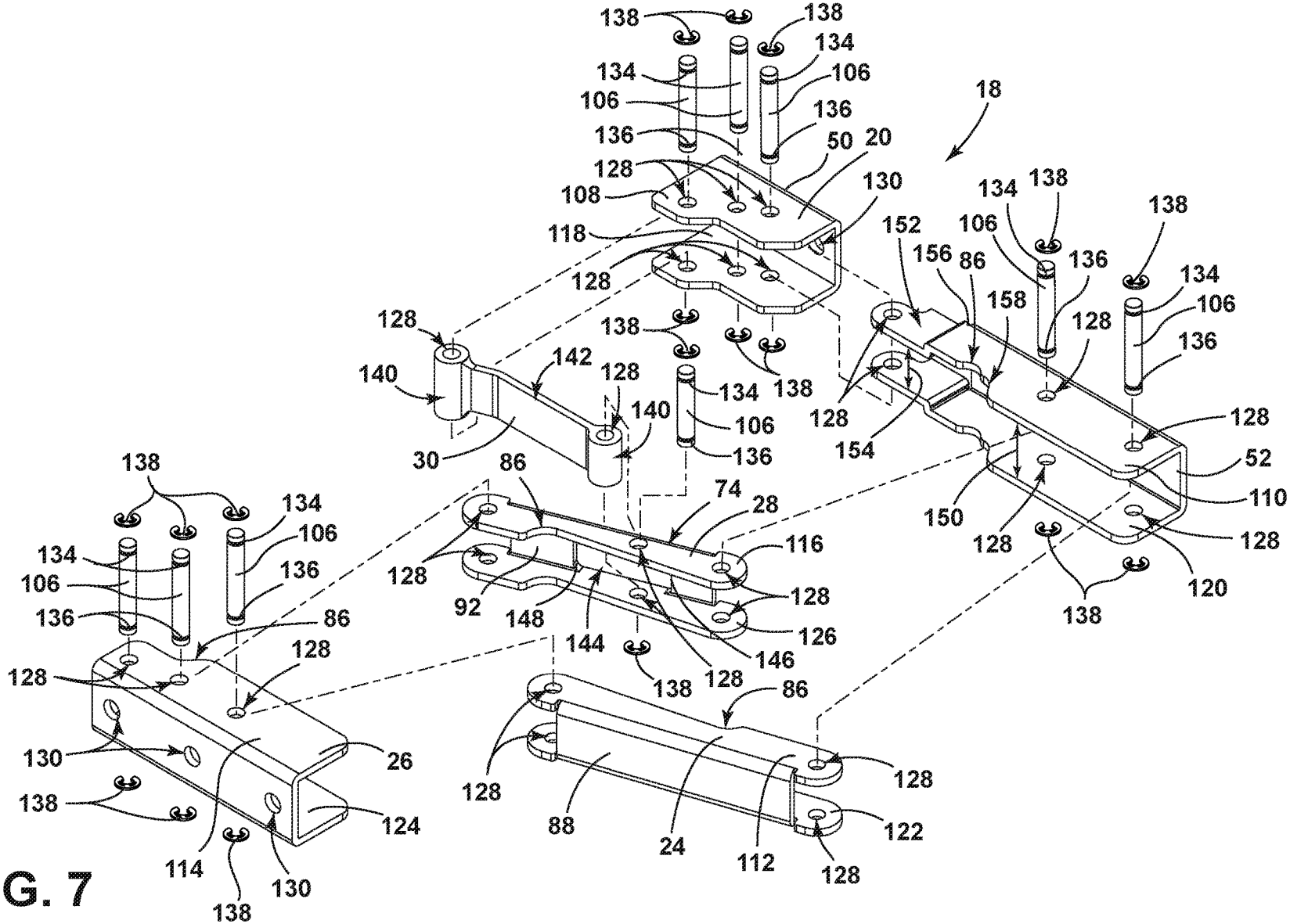
FIG. 7 is an exemplary exploded perspective view of the hinge assembly.

Referring to FIG. 7, as provided herein, any of the links may include a first, possibly horizontally extending surfaces 108, 110, 112, 114, 116 and a second, vertically extending surfaces 50, 52, 88, 90, 92. A second set of surfaces 118, 120, 122, 124, 126, which may be horizontally orientated, may extend from the opposing end of the vertical surface 50, 52, 88, 90, 92 forming one or more "C-shaped" links. According to some examples, the first surfaces 108, 110, 112, 114, 116 may be substantially parallel with the second surfaces 118, 120, 122, 124, 126.

Any surface of the links 20, 22, 24, 26, 28, 30 may define one or more pivot openings 128 and/or fastener openings 130. For example, in the illustrated example, the first member defines three pivot openings 128 in each of the first and second surfaces 108, 118. The three pivot point openings may be vertically aligned such that the pivotable member 132 may be disposed within each respective pair of pivot openings 128. The fastener openings 130 may be configured to have the fastener 102 disposed therethrough for coupling the bracket to an additional surface, such as the cabinet 12 and/or the door 16.

Referring still to FIG. 7, the pivotable members 132 that couple each link to the remaining respective links may be configured as pivot rods 106, although any other fastener may be utilized without departing from the scope of the present disclosure. Each pivot rod 106 may define an upper rim 134 and a lower rim 136. The upper and lower rims 134, 136 may have a smaller circumference than the remaining portions of the pivot rod 106. A clip 138 may be slid into each respective rim by elastically deforming the clip 138. Once the clip 138 is slid into the upper rim 134 and/or the lower rim 136, the clip 138 may return to its original shape and may be removably coupled to the pivot rod 106. The clip 138 has an outer circumference that is larger than the circumference of the pivot opening 128. Accordingly, the pivot rod 106 may be held in place within the pivot opening 128.

With further reference to FIG. 7, the sixth link 30 may include two opposing attachment structures 140 and an elongated, vertically extending body portion 142. According to various examples, the body portion 142 may be substantially parallel in orientation to the vertical surface 50 of the first link 20. The body portion 142 may also be non-linear. In some examples, the vertical orientation of the sixth link 30 may provide support for the hinge assembly 18, and the door 16, when the hinge assembly 18 is disposed in the open position in a vertical direction.

Like the first link 20, the fifth link 28 may include substantially parallel surfaces 116, 126 that are each coupled to a vertically extending surface 92. The vertical surface 92 of the fifth link 28 may define a void 144 therein. The body 142 of the sixth link 30 may extend through the void 144. As the hinge assembly 18 is rotated through a plurality of positions, the sixth link 30 rotates within the void 144. Accordingly, the void 144 may be configured to have a width that accounts for the full range of motion of the hinge assembly 18. In other words, a first side 146 of the void 144 may be disposed laterally outward of the sixth link 30 when the hinge assembly 18 is in the contracted position. A second, opposing side 148 of the void 144 may be laterally outward of the sixth link 30 when the hinge assembly 18 is in the open position.

Figure 8:
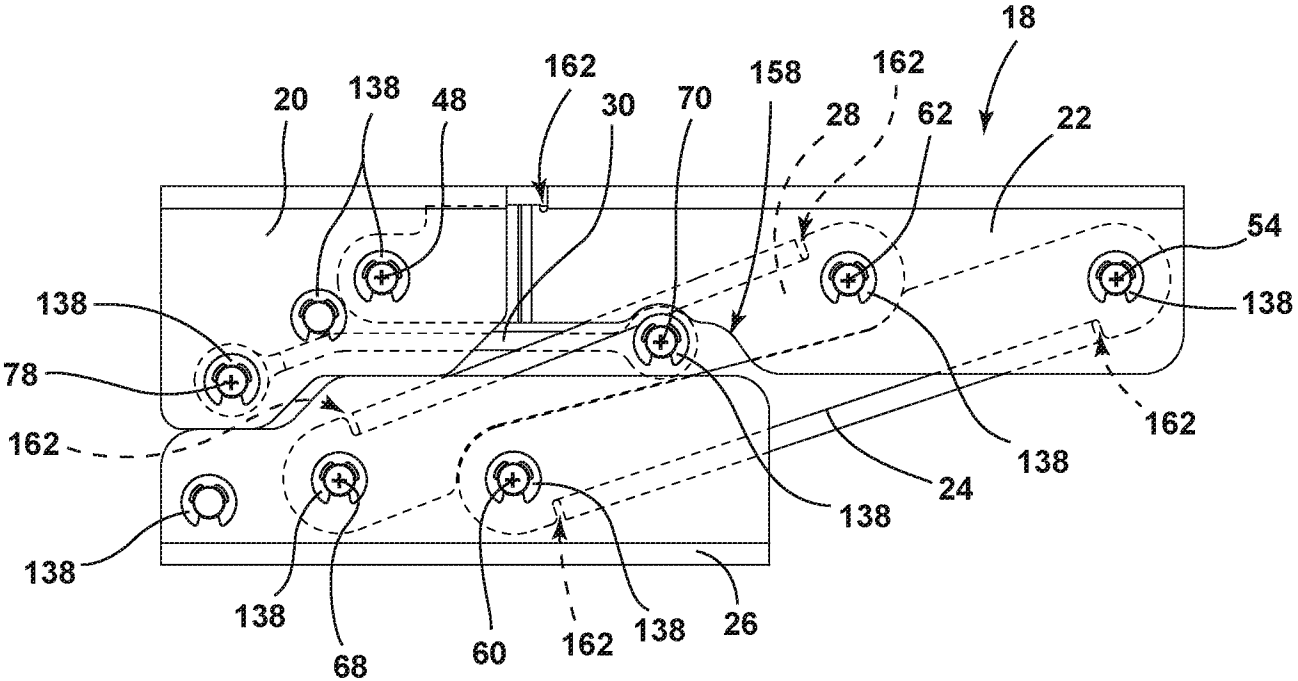
FIG. 8 is a top plan view of the hinge assembly in the contracted position, according to some examples, having at least one link in a vertical orientation.
Figure 9:
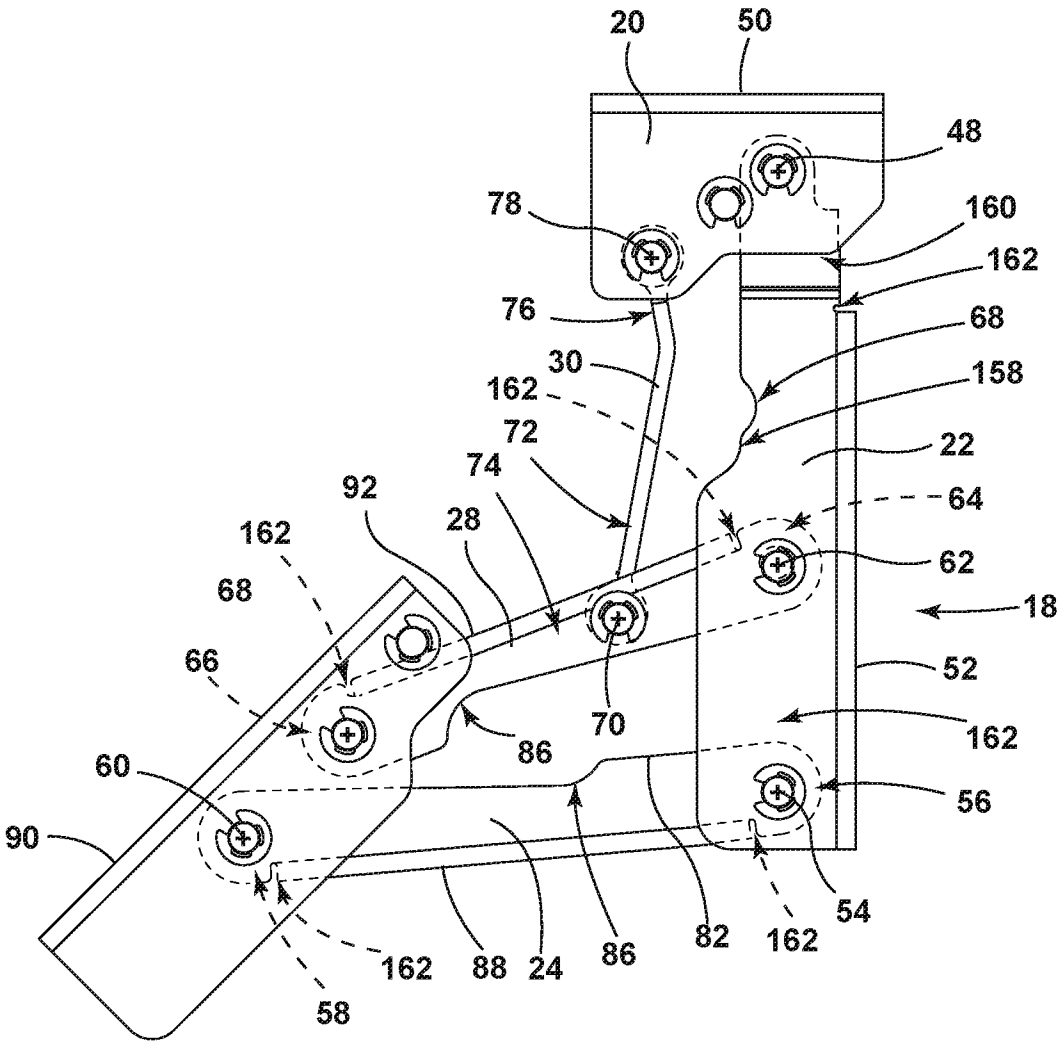
FIG. 9 is a top plan view of the hinge assembly in the expanded position, according to some examples.

Referring still to FIGS. 7-9, the second link 22, like the first link 20, may include a pair of surfaces 110, 120 that extend in a substantially parallel direction with a perpendicular second surface 52 disposed therebetween. The pair of surfaces 110, 120 of the second link 22 is separated by a first distance 150. The second link 22 may also include a coupling portion 152 that is to be disposed between the pair of horizontal surfaces 108, 118 of the first link 20. The surfaces 110, 120 of the second link 22 within the coupling portion 152 may be separated by a second, smaller distance 154 from one another. Accordingly, the coupling portion 152 may be partially disposed within the first link 20. The coupling portion 152 of the second link 22 may provide clearance between the first link 20 and an end portion 156 of the coupling portion 152 as one link 20, 22 rotates about the other link 20, 22 between the contracted and open positions.

The second link 22 may include a first portion 160 that is engageable with the first link 20 and a second portion 162 engageable with the third and fifth links 24, 28. A transition portion 158 may be disposed between the first and second portions 160, 162. The transition portion 158 is configured to increase the width of the pair of surfaces 110, 120 of the second link 22. The transition portion 158 may also include the relief 86 thereon.

Referring still to FIGS. 7-9, some of the links (e.g., the second link 22, the third link 24, and the fifth link 28) may include vertical surfaces 52, 88, 92 that extend less than the full length of the link 22, 24, 28. Accordingly, an indent 182 may be disposed outwardly of each end of the vertical sections. The indent 182 may be cut into the link 22, 24, 28 prior to bending of the vertical surfaces 52, 88, 92.

Figure 10:
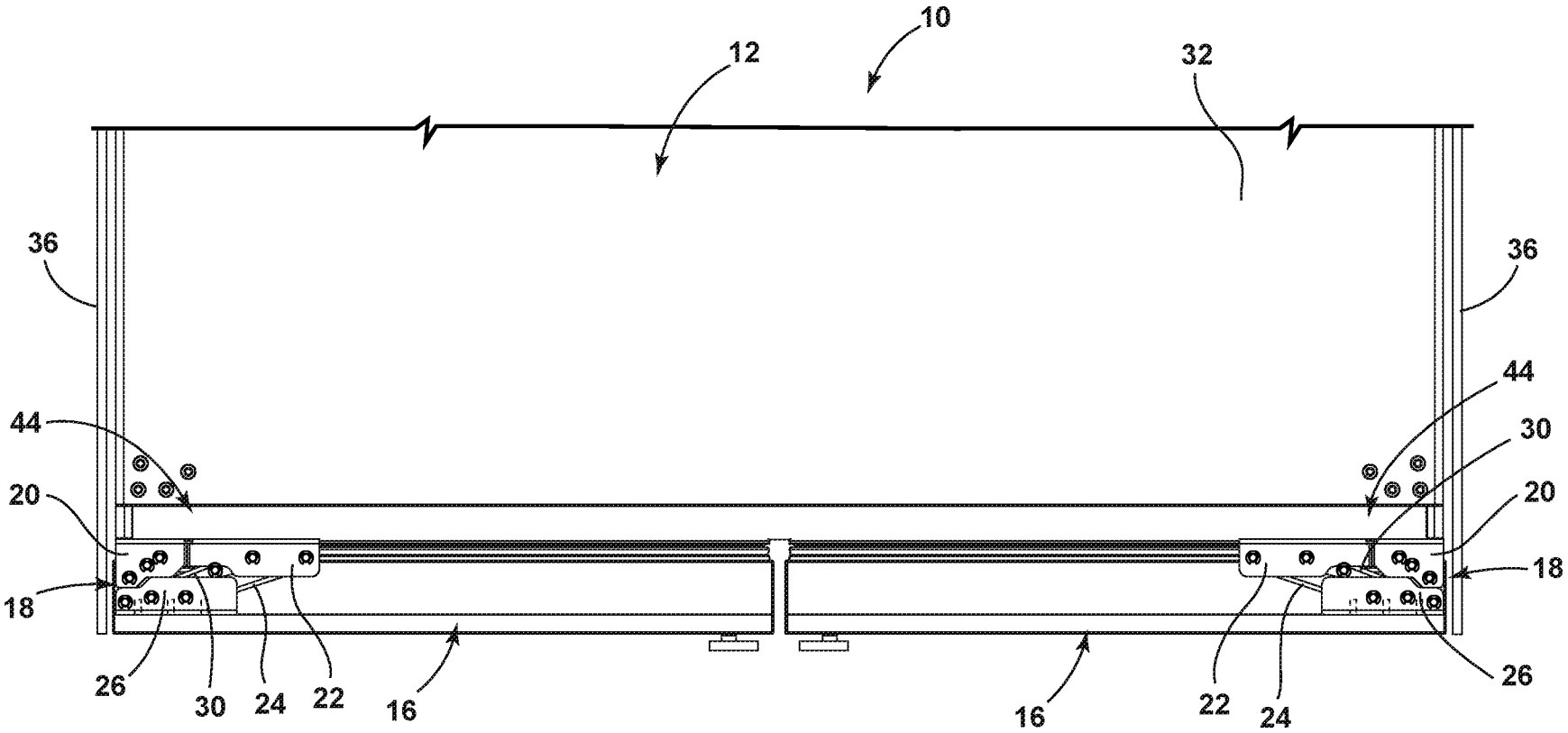
FIG. 10 is a top plan view of the refrigerator having the pair of doors each in a closed position.
Figure 11:
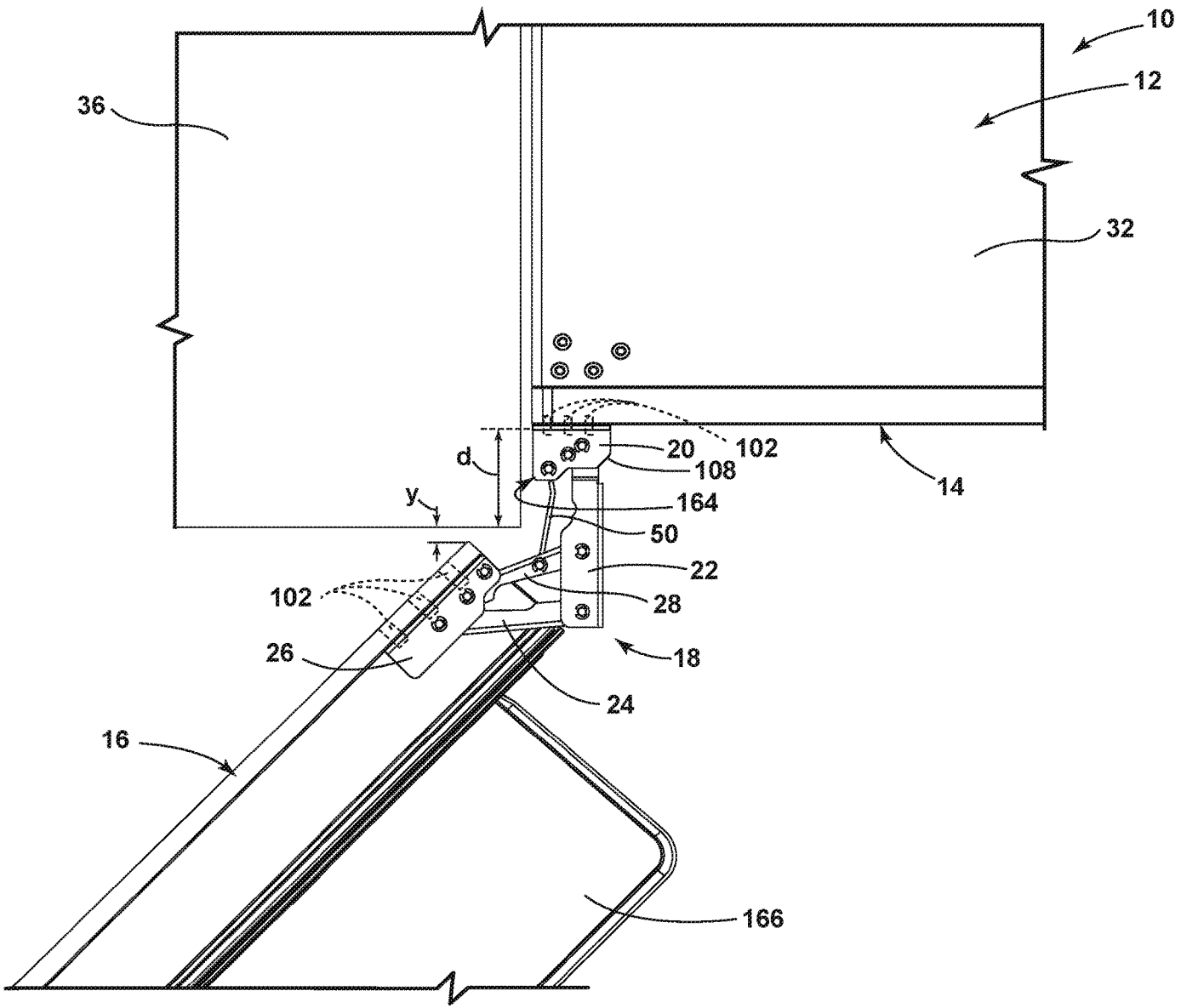
FIG. 11 is a partial top plan view of the refrigerator with the door in an open position.

Referring to FIGS. 10 and 11, as the door 16 moves from a closed position, as illustrated in FIG. 10, to an open position, as illustrated in FIG. 11, the hinge may rotate and/or translates the door 16 laterally outward of the cabinet 12. Accordingly, a bin within the cabinet 12 may be removable without contact with the door 16. Moreover, the sixth link 30, which may have a non-linear orientation, may extend from a position laterally inward of the cabinet 12 to a position laterally outward of the cabinet 12. The sixth link 30 may be connected to a protruding portion 164 of the first link 20 that extends further from the cabinet 12 than the remaining portions of the top surface 108 of the first link 20.

Since the hinge assembly 18 may translate and/or rotate, the door 16 may have a consistent movement distance between opposing sides 98, 100 (FIG. 5) of the door 16. In other words, a small increment in the opening motion of the door 16 induces a corresponding increase in door angle that has an increased perceived value when compared to a pivot point hinge. With a pivot point hinge, a short increment in the opening motion induces a large increment in door angle movement that may feel unnatural or of low perceived value to customers.

The hinge assembly 18 may also be configured such that the door 16 may stay within a clearance distance y of the side wall 36 that extends forwardly of the door 16. In some examples, the door 16 may maintain a clearance distance of less than or equal to 3 mm to prevent an object, such as a finger, from being disposed between the door 16 and the side wall 36 and/or the opposing door 16.

Use of the provided disclosure may offer several advantages. For example, by utilizing the disclosed hinge assembly 18, the door 16 may translate and rotate around an adjacently disposed object(s), such as cabinetry 104. This may be advantageous in that it allows the door 16 to be flushly mounted giving the door 16, and/or the appliance, a built-in appearance. Additionally, the use of the hinge assembly 18 provided herein may also assist in preventing objects from being disposed between the door 16 and the cabinet 12 while the door 16 is rotated. It will be understood that this disclosure may be equally applied to appliances other than just the refrigerator 10. For example, the hinge assembly 18 may be used in conjunction with a microwave oven, a conventional oven, cabinetry, commercial and residential doorways, and/or other uses.

It will be understood by one having ordinary skill in the art that construction of the described invention and other components is not limited to any specific material. Other exemplary examples of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A refrigerator comprising:

a cabinet defining a compartment;

a door configured to seal the compartment and operable between open and closed positions; and a hinge assembly operably coupled to the cabinet and to the door, the hinge assembly comprising:

a first link coupled to the cabinet;

a second link pivotable about the first link;

a third link pivotable about the second link and a fourth link, wherein the fourth link is further coupled to the door;

a fifth link pivotable about the second link and the fourth link and including a vertically extending surface extending between first and second parallel surfaces; and a sixth link pivotable about an intermediate portion of the fifth link and the first link, wherein the sixth link is disposed through a void defined by the vertically extending surface of the fifth link.

2. The refrigerator of claim 1, wherein a surface of the first link and a surface of the second link are substantially parallel in the closed position.

3. The refrigerator of claim 1, wherein the door translates and rotates as the door is moved from the closed position to the open position.

4. The refrigerator of claim 1, wherein each link is coupled to at least one other link by a pivotable member.

5. The refrigerator of claim 4, wherein the pivotable member is configured as a pivot rod that includes clips on two opposing end portions of the pivot rod.

6. The refrigerator of claim 1, wherein the second link includes a first portion having a first thickness and a second portion having a second, larger thickness.

7. The refrigerator of claim 1, wherein the second link includes a relief that is configured as a notch to prevent interference between the second link and the third link.

8. The refrigerator of claim 1, wherein:

the cabinet includes a pair of side walls; and the six-link mechanism maintains the door within a distance of less than 5 mm from at least one side wall of the pair of side walls when the door is moved from the closed position to the open position.

9. A refrigerator comprising:

a cabinet defining a compartment, wherein the cabinet includes a pair of side walls that extend forwardly of the compartment;

a door coupled to the cabinet; and a hinge assembly coupled to the cabinet and to the door, wherein the hinge assembly includes a six-link mechanism that translates and rotates the door forwardly and outwardly of at least one side wall when the door is moved from a closed position to the open position, the six-link mechanism including:

a first link coupled to the cabinet;

a second link pivotable about the first link;

a third link pivotable about the second link and a fourth link coupled to the door;

a fifth link pivotable about the second link and the fourth link;

a sixth link pivotable about an intermediate portion of the fifth link and the first link;

a first raised portion extending from a horizontal surface of the second link; and a second raised portion extending from a horizontal surface of the fourth link, the first and second raised portions configured as stops, wherein the third link contacts the first raised portion when the door is in the closed position and the third link contacts the second raised portion when the door is in the open position.

10. The refrigerator of claim 9, wherein a front surface of the at least one side wall and a front surface of the door are substantially aligned when the door is in the closed position.

11. The refrigerator of claim 9, wherein the hinge assembly has a contracted thickness that is less than the thickness of the door.

12. The refrigerator of claim 9, wherein at least one link of the hinge assembly includes a first planar surface and a second transversely disposed surface.

13. The refrigerator of claim 9, wherein at least one link of the six-link mechanism includes a relief thereon.

14. The refrigerator of claim 9, wherein a bin on the door is disposed laterally outward of the compartment when the door is placed in the open position.

15. The refrigerator of claim 9, wherein the six-link mechanism maintains the door within a distance of no more than 3 mm from at least one side wall of the pair of side walls when the door is moved from the closed position to the open position.

16. A refrigerator comprising:

a cabinet defining a compartment and including a pair of side walls that extends forwardly of the compartment;

a door coupled to the cabinet; and a hinge assembly coupled to the cabinet and to the door, wherein the hinge assembly includes a six-link mechanism that maintains the door within a predefined clearance distance of at least one side wall when the door is moved from the closed position to the open position, the six-link mechanism including:

a first link coupled to the cabinet;

a second link pivotable about the first link;

a third link pivotable about the second link and a fourth link coupled to the door;

a fifth link pivotable about the second link and the fourth link;

a sixth link pivotable about an intermediate portion of the fifth link and the first link; and a stop extending from a horizontal surface of the fourth link, wherein an interior surface of the third link contacts the stop when the door is in the open position.

17. The refrigerator of claim 16, wherein the predefined distance is less than 5 mm from the at least one side wall.

18. The refrigerator of claim 16, wherein the door is disposed forwardly and outwardly of at least one side wall when the door is moved from the closed position to the open position.

19. The refrigerator of claim 16, wherein the fifth link includes a vertically extending surface extending between first and second horizontal surfaces, and the vertically extending surface includes a void and the sixth link extends at least partially through and rotates within the void.

20. The refrigerator of claim 16, wherein each link is coupled to at least one other link through a pivotable member.

* * * * *